US007121089B2

(12) United States Patent
Tosen et al.

(10) Patent No.: US 7,121,089 B2
(45) Date of Patent: Oct. 17, 2006

(54) HYDRAULIC CYLINDER

(75) Inventors: Masahiro Tosen, Fukushima (JP); Tatsuya Futami, Fukushima (JP); Kenji Kanemaru, Kanagawa (JP); Yoshiaki Yamamoto, Kanagawa (JP)

(73) Assignees: Komatsu Ltd., Tokyo (JP); Komatsu Zenoah Co., Saitama (JP)

( * ) Notice: Subject to any disclaimer, the term of this patent is extended or adjusted under 35 U.S.C. 154(b) by 53 days.

(21) Appl. No.: 10/972,386

(22) Filed: Oct. 26, 2004

(65) Prior Publication Data

US 2005/0086934 A1 Apr. 28, 2005

(30) Foreign Application Priority Data

Oct. 28, 2003 (JP) ..... 2003-367610

(51) Int. Cl.
*F15B 1/02* (2006.01)
*F15B 1/24* (2006.01)

(52) U.S. Cl. ..... 60/413; 60/469; 92/60; 92/85 B; 92/110

(58) Field of Classification Search ..... 60/413, 60/417, 469; 92/58.1, 60, 110, 115, 109, 92/134, 130 B, 169.1, 85 B
See application file for complete search history.

(56) References Cited

U.S. PATENT DOCUMENTS 3,191,506 A * 6/1965 Ledeen ..... 92/60
3,541,952 A * 11/1970 Clar ..... 92/111
3,869,861 A * 3/1975 Case ..... 60/413
4,381,857 A * 5/1983 Cook ..... 267/64.15
4,859,006 A * 8/1989 Philippe et al. ..... 305/148
5,024,465 A * 6/1991 Baiker ..... 280/6.154

FOREIGN PATENT DOCUMENTS

| | | |
|---|---|---|
| GB | 1 236 384 | 6/1971 |
| GB | 1 306 609 | 1/1973 |
| GB | 2 000 227 | 1/1979 |
| JP | 49-104075 | 10/1974 |

* cited by examiner

*Primary Examiner*—Igor Kershteyn
(74) *Attorney, Agent, or Firm*—Wenderoth, Lind & Ponack, L.L.P.

(57) ABSTRACT

In a hydraulic cylinder having a shock absorbing function, and capable of stopping as desired by an accumulator disposed within a cylinder rod. The accumulator includes an accumulator piston that divides the cylinder rod interior into first and second cylinder rod chambers, gas hermetically charged into the second cylinder rod chamber, and an accumulation port that is communicated with the first cylinder rod chamber and flows the operating oil from outside into the first cylinder rod chamber.

4 Claims, 10 Drawing Sheets

HYDRAULIC CYLINDER

BACKGROUND OF THE INVENTION

1. Field of the Invention

The present invention relates to a hydraulic cylinder to be used for civil engineering machines such as a power shovel or equipment that is driven by a hydraulic pressure, and more particularly to improvements of a hydraulic cylinder having a shock absorbing function.

2. Description of the Related Art

Conventionally, a hydraulic cylinder is used for various types of civil engineering machines such as a power shovel to drive a working machine such as a bucket.

The hydraulic cylinder is provided with a cylinder rod that performs a linear reciprocating motion within a cylinder by a hydraulic pressure of an operating oil.

The cylinder rod is provided at its one end with a cylinder piston inserted into the cylinder, and the interior of the cylinder is divided into two cylinder chambers by the cylinder piston.

The operating oil is supplied under pressure into one of the two cylinder chambers to linearly move the cylinder rod in an extending direction, and into the other cylinder chamber to linearly move the cylinder rod in a retracting direction, whereby a working machine such as a bucket connected to the end of the cylinder rod is driven to operate.

In order to control the movement of the working machine, there is an occasion in which the hydraulic cylinder stops feeding of the operating oil under pressure to the cylinder chamber by the control valve, whereby the linear movement of the cylinder rod is stopped temporarily.

In such an occasion, if the feeding of the operating oil under pressure to the cylinder chamber is stopped suddenly, the operating oil accumulated in the cylinder chamber is compressed by an inertial force of the cylinder piston. Due to the incompressibility of the operating oil, the operating oil accumulated in the cylinder chamber becomes high resistance so that the cylinder rod stops suddenly. As a result, the cylinder itself receives a large shock, resulting in the generation of large vibration and noise in the equipment using the hydraulic cylinder.

Japanese patent application publication no. 49-104075 discloses the configuration in which an accumulator, which has a shock absorbing function comprising an accumulator piston and a coil spring supporting the accumulator piston, is disposed in a cylinder rod, and both sides of the accumulator piston are constantly communicated with respective corresponding cylinder chambers.

According to the hydraulic cylinder disclosed in Japanese patent application publication no. 49-104075, when the operating oil being fed under pressure to the cylinder chamber is stopped suddenly in order to stop the action of the cylinder rod, the operating oil accumulated in the cylinder chamber is compressed by an inertial force of the cylinder piston connected to the cylinder rod. The operating oil compressed in the cylinder chamber frees in part to the accumulator piston side, and the coil spring is pushed to be extended/retracted by the pressure of the freed portion of the operating oil via the accumulator piston. The pressure of the operating oil in the cylinder chamber is gradually absorbed by the damper function of the coil spring, which is extended/retracted by the hydraulic pressure of the freed operating oil, until it balances with the pressure due to the coil spring. Thus, the shock generated in the cylinder is reduced.

Incidentally, in the conventional hydraulic cylinder that has the accumulator having the shock absorbing function disposed in the cylinder rod as described in Japanese patent application publication no. 49-104075, the accumulator is constituted by an accumulator piston and a coil spring that supports the accumulator piston, and the both sides of the accumulator piston are kept communicated with their corresponding cylinder chambers through oil passages, so that the shock absorbing function is constantly acting on the hydraulic cylinder.

Therefore, with the conventional hydraulic cylinder, when the cylinder rod is stopped suddenly to quickly stop the working machine at a prescribed position, the cylinder rod is kept vibrating until the hydraulic pressure in the cylinder chamber and the pressure of the spring of the accumulator are balanced with each other by the shock absorbing function of the accumulator that keeps acting. Thus, the conventional hydraulic cylinder has a disadvantage that the working machine such as a bucket cannot be stopped and positioned quickly at a prescribed position by suddenly stopping the cylinder rod.

SUMMARY OF THE INVENTION

The present invention has been made in view of the above circumstances and provides a hydraulic cylinder that can freely perform and stop a shock absorbing function of an accumulator disposed within a cylinder rod.

To solve the above problems, the present invention is directed to a hydraulic cylinder having an accumulator disposed within a cylinder rod, wherein the accumulator is provided with at least an accumulator piston that is inserted into the cylinder rod and divides the cylinder rod interior into first and second cylinder rod chambers; gas that is hermetically charged into the second cylinder rod chamber; and an accumulation port that is communicated with the first cylinder rod chamber to flow an operating oil from the outside of the hydraulic cylinder into the first cylinder rod chamber.

With the above-described configuration of the hydraulic cylinder, when the shock absorbing function is performed to stop the operation of the cylinder rod, the operating oil compressed by the cylinder piston is guided from the outside of the hydraulic cylinder to the first cylinder rod chamber of the accumulator via the accumulation port. Thus, the shock absorbing function is activated by gradually absorbing the pressure of the operating oil until the pressure of the operating oil applied to the accumulator piston is balanced with the pressure of the gas hermetically charged into the second cylinder rod chamber. In order for the shock absorbing function not to be performed, the operating oil compressed by the cylinder piston is prevented from flowing into the accumulation port.

According to the present invention, the on/off control of the shock absorbing function by the accumulator of the hydraulic cylinder can be made by a simple structure whereby vibrations and noise in the equipment using the hydraulic cylinder can be reduced. Also, the present invention provides equipment using a highly reliable hydraulic cylinder by preventing a breakage of seal, oil leakage, and a deformation of tubes or the like in the hydraulic circuit including the hydraulic cylinder.

BRIEF DESCRIPTION OF THE DRAWINGS

Embodiments of the present invention will be described in detail based on the following figures, wherein.

DESCRIPTION OF THE PREFERRED EMBODIMENTS

Embodiments of the hydraulic cylinder according to the present invention will be described in detail with reference to the accompanying drawings.

Figure 1:
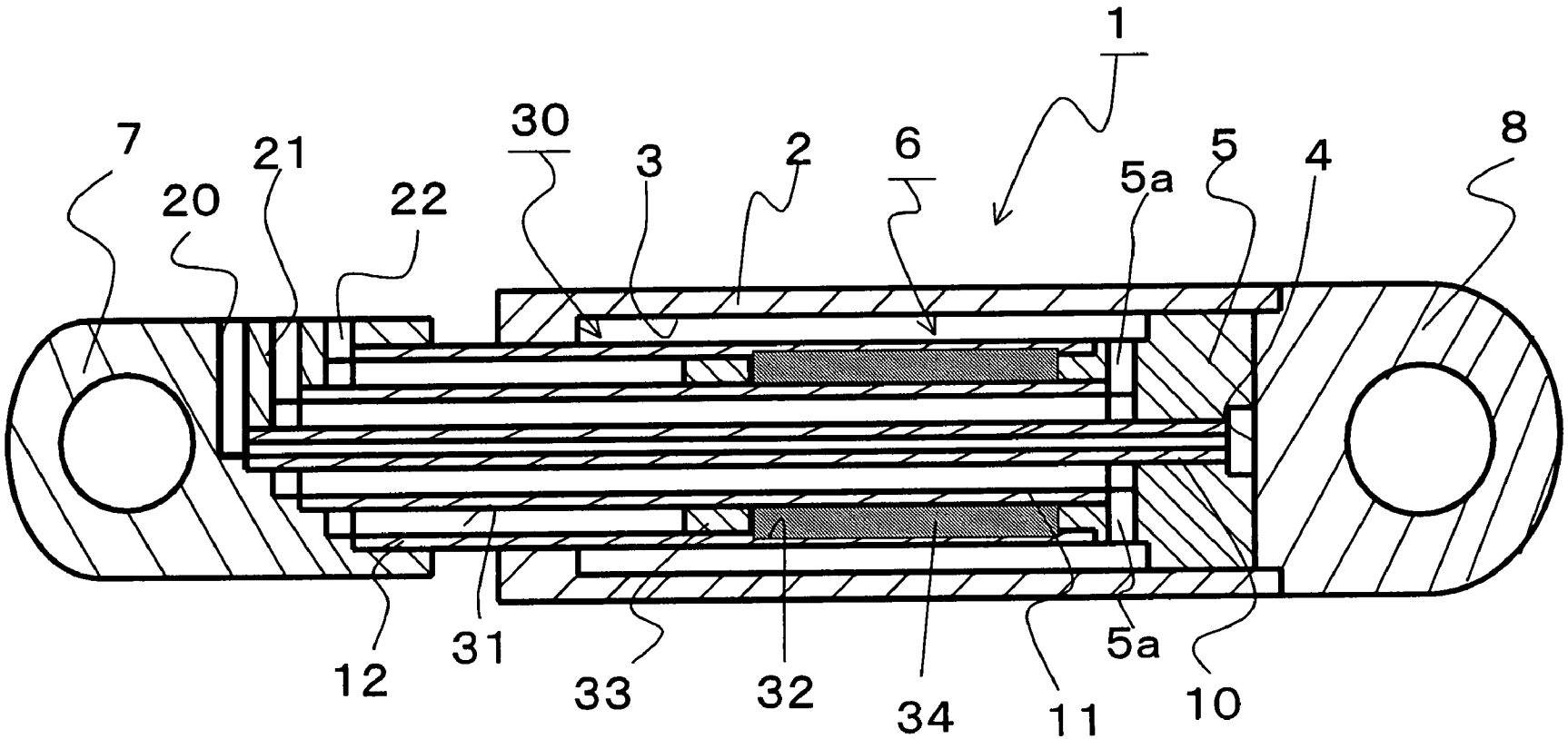
FIG. 1 is a schematic sectional view of the hydraulic cylinder according to an embodiment of the present invention.

FIG. 1 is a schematic sectional view showing a hydraulic cylinder 1 according to an embodiment of the present invention.

The hydraulic cylinder 1 comprises a cylinder 2, a cylinder piston 5, which is inserted into the cylinder 2 and divides the cylinder 2 into a first cylinder chamber 3 and a second cylinder chamber 4, and a cylinder rod 6 with the cylinder piston 5 fixed to its one end. To the right end of the cylinder 2 and the left end of the cylinder rod 6A, a rod head 7 and a cylinder head 8 each having a hole for connection of equipment such as a working machine are fixed.

The cylinder rod 6 has a concentric triple tubular structure comprising a first guide tube 10 having a small diameter, a second guide tube 11 having an intermediate diameter for surrounding the first guide tube 10 and a third guide tube 12 having a large diameter for surrounding the second guide tube 11.

Among the first to third guide tubes 10, 11, 12, the right end of the first guide tube 10 is communicated with the second cylinder chamber 4, and its left end is communicated with a head side port 20 formed in the rod head 7.

The second guide tube 11 has its right end communicated with the first cylinder chamber 3 through a hole 5*a* formed in the cylinder piston 5, and its left end communicated with a bottom side port 21 formed in the rod head 7.

An accumulator 30 having a shock absorbing function, which is a major component of the present invention, is disposed in the third guide tube 12 having the largest diameter.

The accumulator 30 comprises an accumulator piston 33 that is inserted into the third guide tube 12 and divides the third guide tube 12 into a first cylinder rod chamber 31 and a second cylinder rod chamber 32, a compressive gas 34 that is filled into the second cylinder rod chamber 32 and an accumulation port 22 that is formed in the rod head 7 and communicated with the first cylinder rod chamber 31.

The head side port 20, the bottom side port 21 and the accumulation port 22 are formed at positions adjacent to one another in the rod head 7.

The action of the hydraulic cylinder 1 will be described, and its structure will also be described in further detail.

Figure 2:
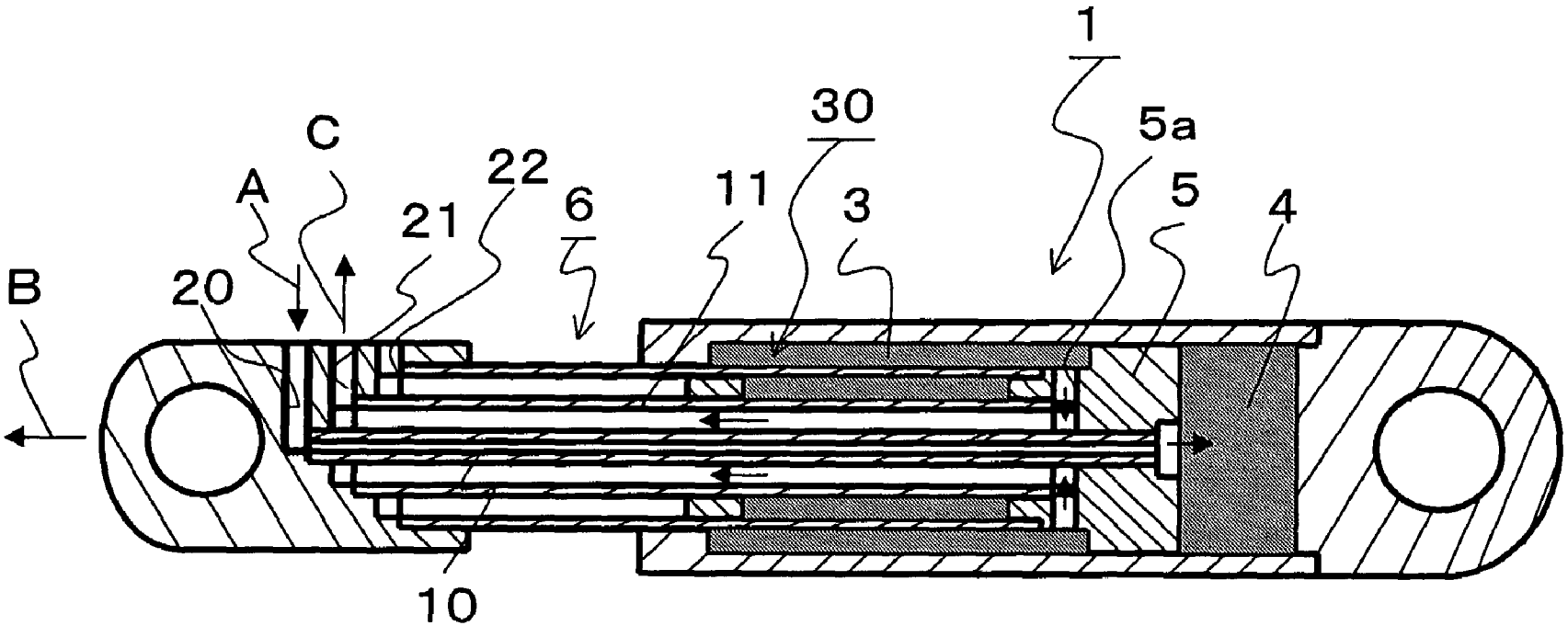
FIG. 2 is a schematic sectional view showing a normal operational state of the hydraulic cylinder according to the embodiment of the present invention.

Referring to FIG. 2, when the cylinder rod 6 is extended in a normal operation, an operating oil A is fed under pressure from the head side port 20 into the first guide tube 10 by using an operating oil supply means (not shown) comprising a hydraulic motor, control valve, etc., thereby filling the second cylinder chamber 4 with the operating oil. Thus, the cylinder rod 6 is extended via the cylinder piston 5 as indicated by an arrow B. To extend the cylinder rod 6, the operating oil filled in the first cylinder chamber 3 flows into the second guide tube 11 through the hole 5*a*, and the operating oil flown into the second guide tube 11 is discharged as indicated by an arrow C through the bottom side port 21.

Figure 3:
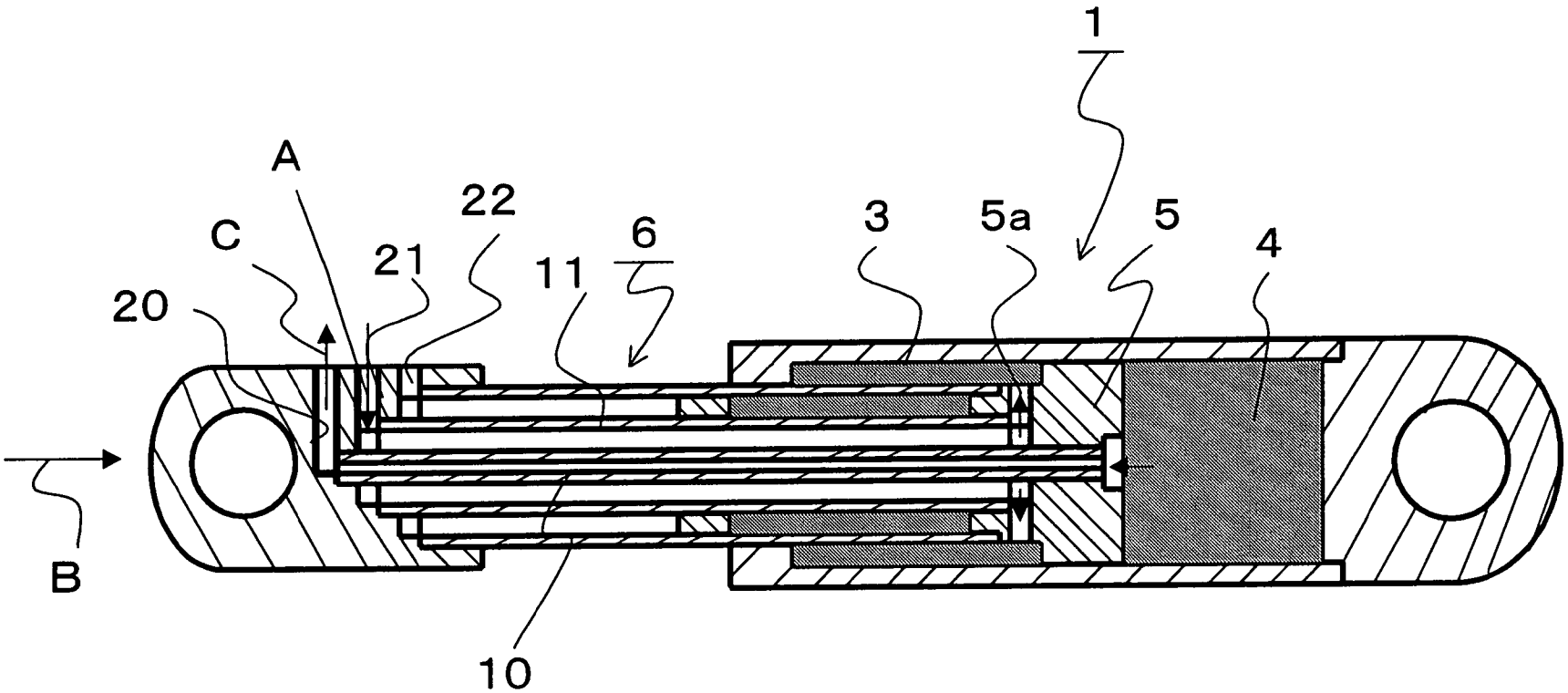
FIG. 3 is a schematic sectional view showing a normal operational state of the hydraulic cylinder according to the embodiment of the present invention.

On the other hand, referring to FIG. 3, when the cylinder rod 6 is retracted in a normal operation, the operating oil A is fed under pressure from the bottom side port 21 into the second guide tube 11, thereby filling the operating oil into the first cylinder chamber 3 through the hole 5*a*. Thus, the cylinder rod 6 is retracted via the cylinder piston 5 as indicated by the arrow B. To retract the cylinder rod 6, the operating oil filled in the second cylinder chamber 4 flows into the first guide chamber 10, and the operating oil flown into the first guide tube 10 is discharged through the head side port 20 as indicated by the arrow C.

Now, an operation to stop the cylinder rod 6 at a desired position where the cylinder rod 6 moves in a normal operation will be described in case of extending the cylinder rod 6 as an example.

In this case, an inflow of the operating oil A and an outflow of the operating oil C shown in FIG. 2 are stopped by, for example, a control valve.

Then, the operating oil accumulated in the first cylinder chamber 3 is compressed by the inertial force of the cylinder piston 5. At that time, the operating oil accumulated in the first cylinder chamber 3 operates as a large resistance because of the incompressibility of the operating oil accumulated in the first cylinder chamber 3. Then, the cylinder rod 6 is stopped suddenly so as to stop at a desired position accurately. In this case, there is naturally a possibility that the cylinder itself may produce a large shock because the hydraulic cylinder has the same function as before.

For example, when the cylinder rod 6 is desired to stop suddenly at a prescribed position while it is retracting in a normal operation, the inflow of the operating oil A and the outflow of the operating oil C shown in FIG. 3 are stopped by the control valve for example.

Then, the operating oil accumulated in the second cylinder chamber 4 is compressed by the inertial force of the cylinder piston 5, the operating oil accumulated in the second cylinder chamber 4 operates as a large resistance because of the incompressibility of the operating oil accumulated in the second cylinder chamber 4, and the cylinder rod 6 is stopped suddenly to stop accurately at a desired position. There is naturally a possibility that the cylinder itself may produce a large shock because the hydraulic cylinder comes to have the same function as in the conventional hydraulic cylinder.

As an example of the above-described case in which it is necessary to stop quickly the cylinder rod 6 at a desired position, there is a case in which a working machine such as a blade or a bucket connected to the cylinder rod is desired to be positioned quickly and accurately on the ground surface in order to perform a ground-leveling work by a civil engineering machine.

Then, the above-described shock absorbing function using the accumulator 30 of the hydraulic cylinder 1 according to the embodiment will be described.

Figure 4:
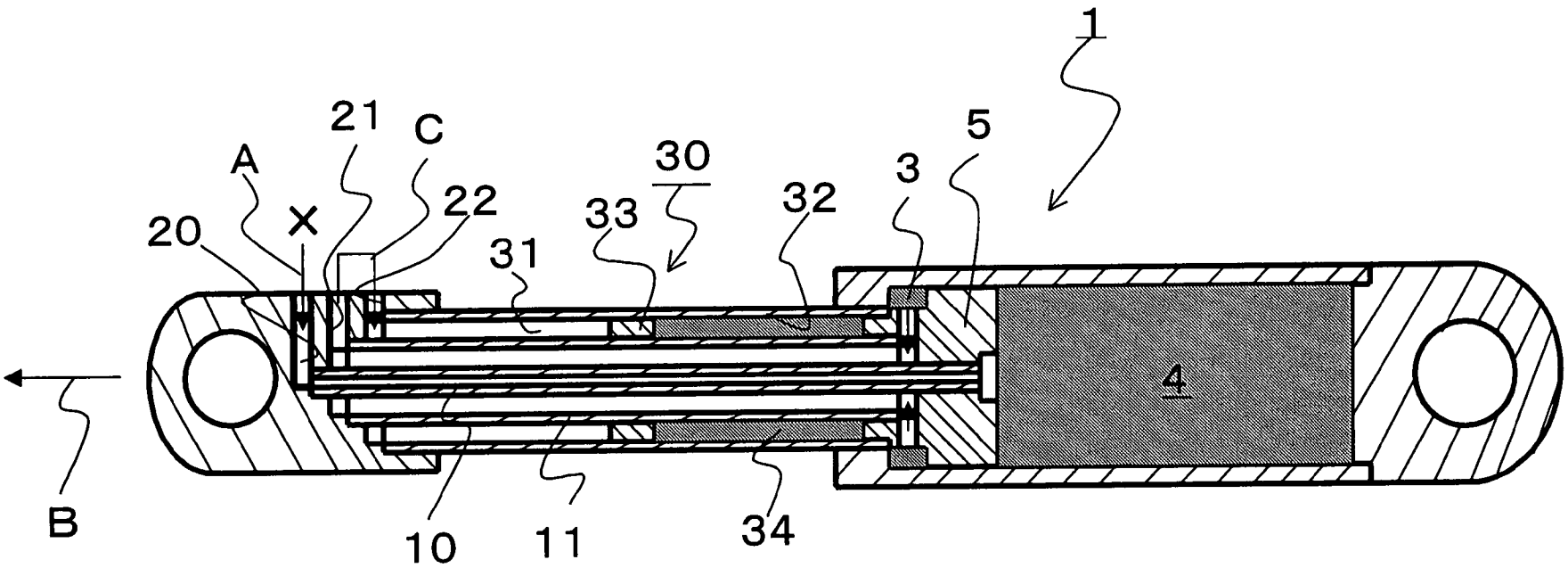
FIG. 4 is a schematic sectional view showing a state that a shock absorbing function of the hydraulic cylinder according to the embodiment of the present invention is activated.

As shown in FIG. 2, when the cylinder rod 6 that is extended is stopped from moving on the bottom side of the cylinder 2 by the shock absorbing function of the accumulator 30, a control valve or the like (not shown) is used to stop the supply of the operating oil A that is fed under pressure from the head side port 20 into the first guide tube 10 as shown in FIG. 4. At the same time, the bottom side port 21 and the accumulation port 22 are communicated with each other to guide the operating oil C of the first cylinder chamber 3 flowing out of the bottom side port 21 into the first cylinder rod chamber 31 of the accumulator 30.

Figure 5:
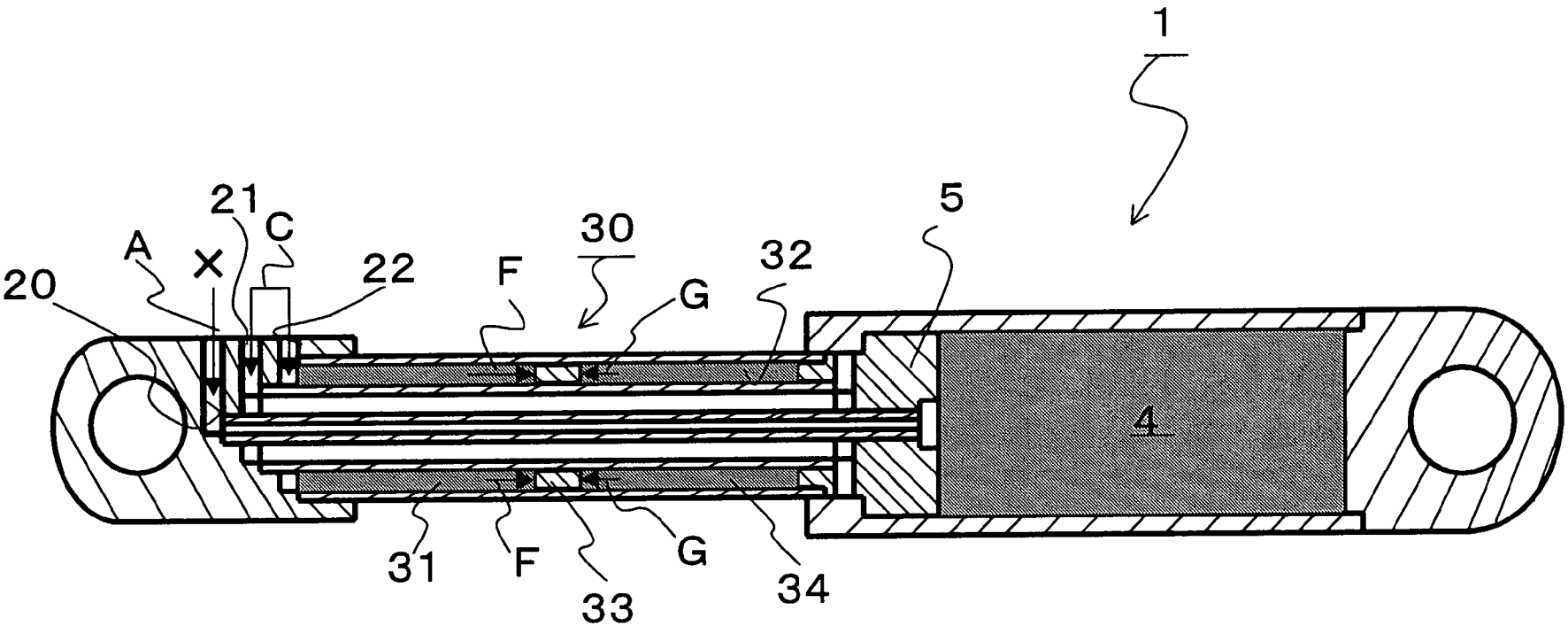
FIG. 5 is a schematic sectional view showing a state that the shock absorbing function of the hydraulic cylinder according to the embodiment of the present invention is activated.

Thus, when the operating oil C of the first cylinder chamber 3 flowing out of the bottom side port 21 is guided into the first cylinder rod chamber 31 of the accumulator 30, the accumulator piston 33 is pushed by the pressure of the operating oil C compressed by the cylinder piston 5 as shown in FIG. 5, and its pressure F reduces gradually until the pressure F is balanced with a pressure G by the compressive gas 34 that is hermetically charged into the second cylinder rod chamber 32 with the accumulator piston 33 therebetween.

Thus, with the use of the accumulator 30, the damper function of the accumulator 30 utilizing the compressibility of the gas 34 enables to absorb a shock produced when the cylinder rod 6 is stopped suddenly while it is extended.

Figure 6:
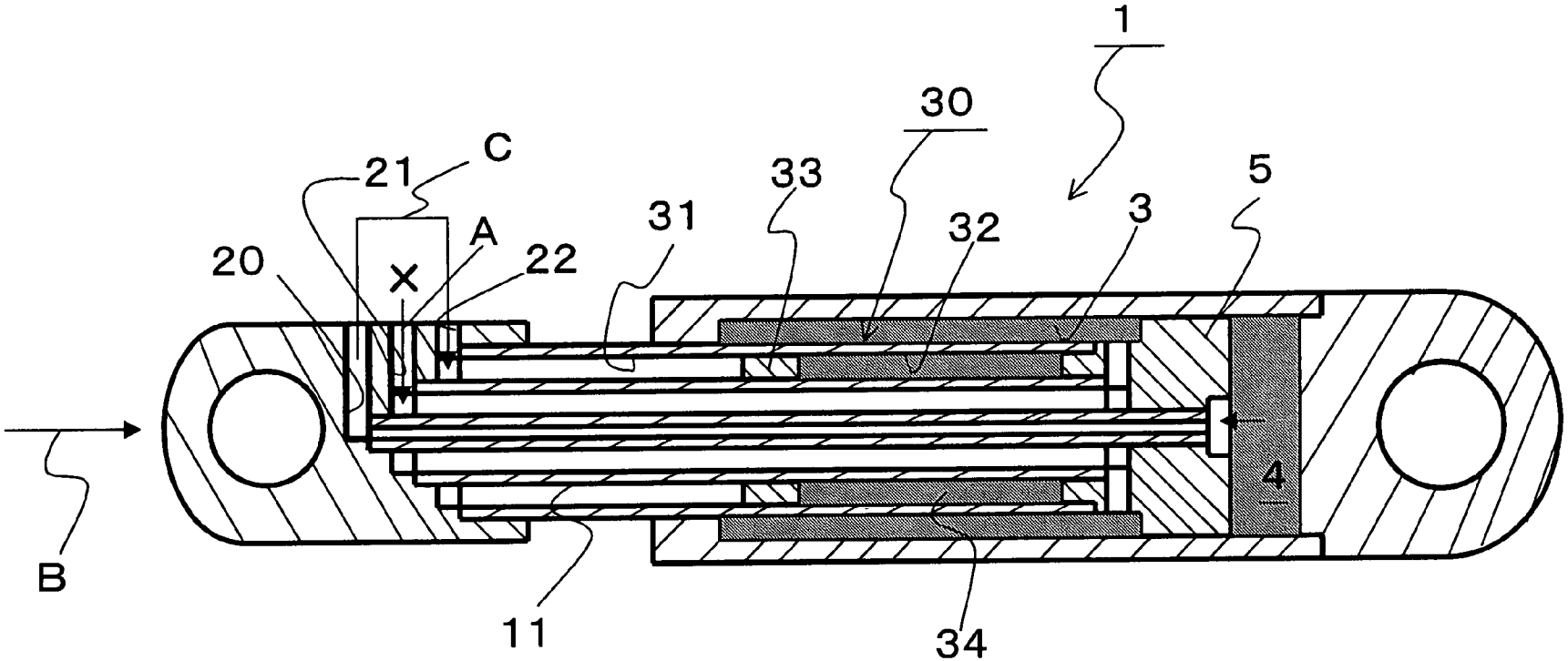
FIG. 6 is a schematic sectional view showing a state that the shock absorbing function of the hydraulic cylinder according to the embodiment of the present invention is activated.

Similarly, where the movement of the cylinder rod 6 is to be stopped on the head side of the cylinder 2 by using the shock absorbing function by the accumulator 30 when the cylinder rod 6 is retracted, a control valve or the like (not shown) is used to stop the supply of the operating oil A that is fed under pressure from the bottom side port 21 into the second guide tube 11 as shown in FIG. 6. At the same time, the head side port 20 and the accumulation port 22 are communicated with each other to guide the operating oil C of the second cylinder chamber 4 flowing out of the head side port 20 into the first cylinder rod chamber 31 of the accumulator 30.

Figure 7:
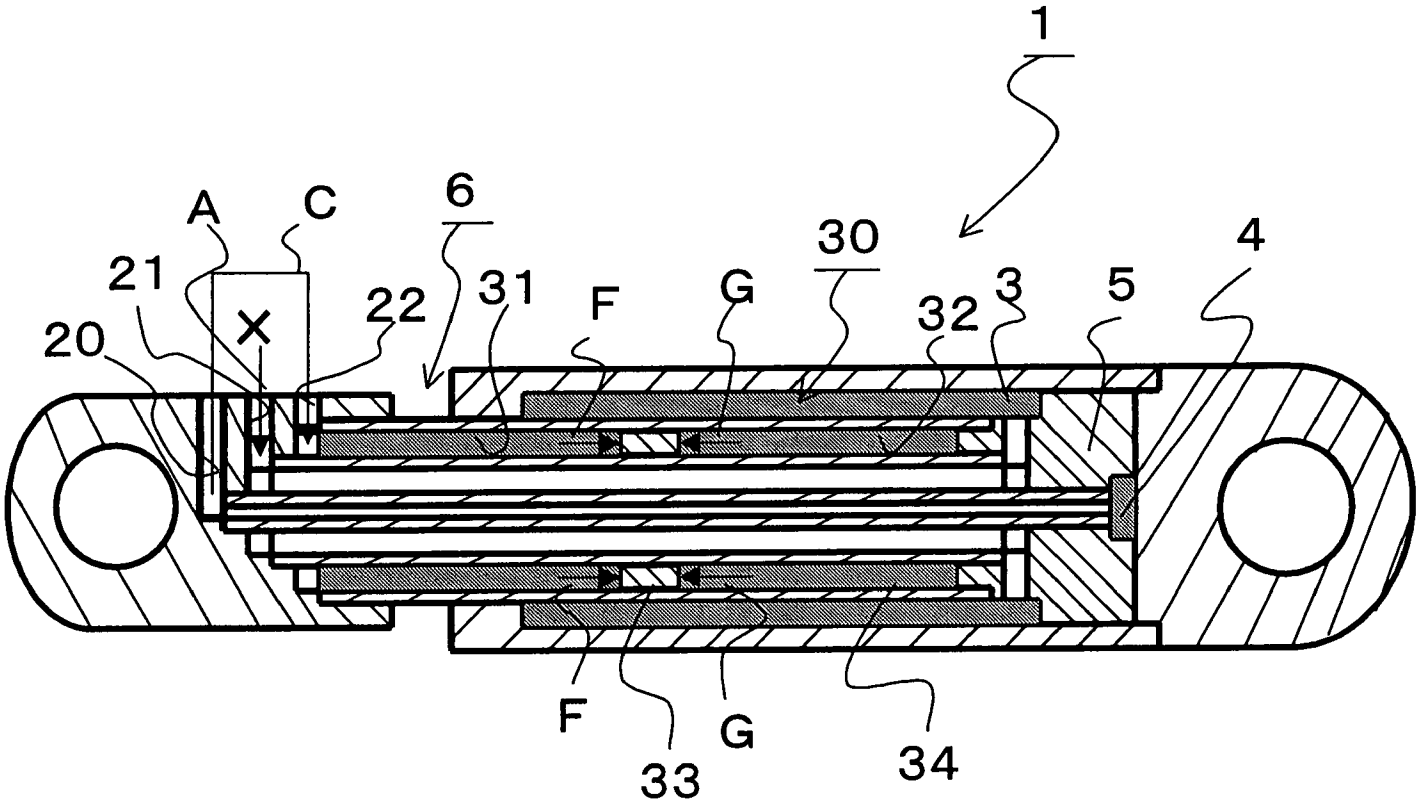
FIG. 7 is a schematic sectional view showing a state that the shock absorbing function of the hydraulic cylinder according to the embodiment of the present invention is activated.

Thus, when the operating oil C filled in the second cylinder chamber 4 and flown out of the head side port 20 is guided into the first cylinder rod chamber 31 of the accumulator 30, the pressure of the operating oil C reduces gradually until the pressure F of the operating oil C is compressed by the cylinder piston 5 and the pressure G of the gas 34 hermetically charged into the second cylinder rod chamber 32 are balanced with the accumulator piston 33 between them as shown in FIG. 7. A shock produced when the cylinder rod 6 is suddenly stopped at the time of retraction by the damper function utilizing the compressibility of the gas 34 can also be absorbed.

In the above description, the shock absorbing function of the acting accumulator 30 when the cylinder piston 5 is stopped on the head side or the bottom side of the cylinder piston 5 in the cylinder 2 was explained in detail. In the hydraulic cylinder 1 of the present invention, however, the shock absorbing function of the accumulator 30 can also be activated even when the cylinder piston 5 in the cylinder 2 is stopped at a desired position between the head side and the bottom side of the cylinder piston 5.

Figure 8:
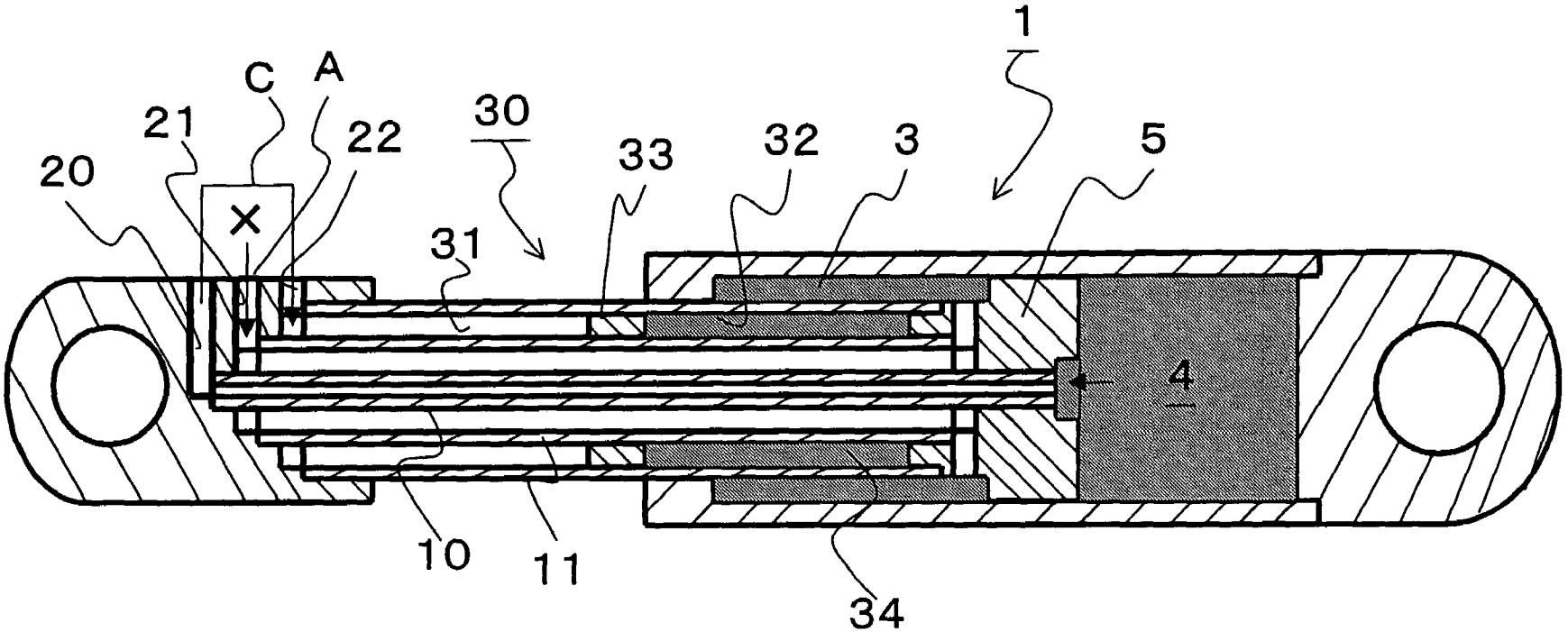
FIG. 8 is a schematic sectional view showing a state that the shock absorbing function of the hydraulic cylinder according to the embodiment of the present invention is activated.

Specifically, when, for example, the cylinder rod 6 is retracted and stopped at a desired position as shown in FIG. 3, and when the shock absorbing function of the accumulator 30 is activated at that time, a control valve or the like (not shown) is used to stop the supply of the operating oil A, which is fed under pressure from the bottom side port 21 into the second guide tube 11 as shown in FIG. 8 and, at the same time, the head side port 20 and the accumulation port 22 are mutually communicated with each other to guide the operating oil C flowing out of the head side port 20 into the first cylinder rod chamber 31 of the accumulator 30.

Figure 9:
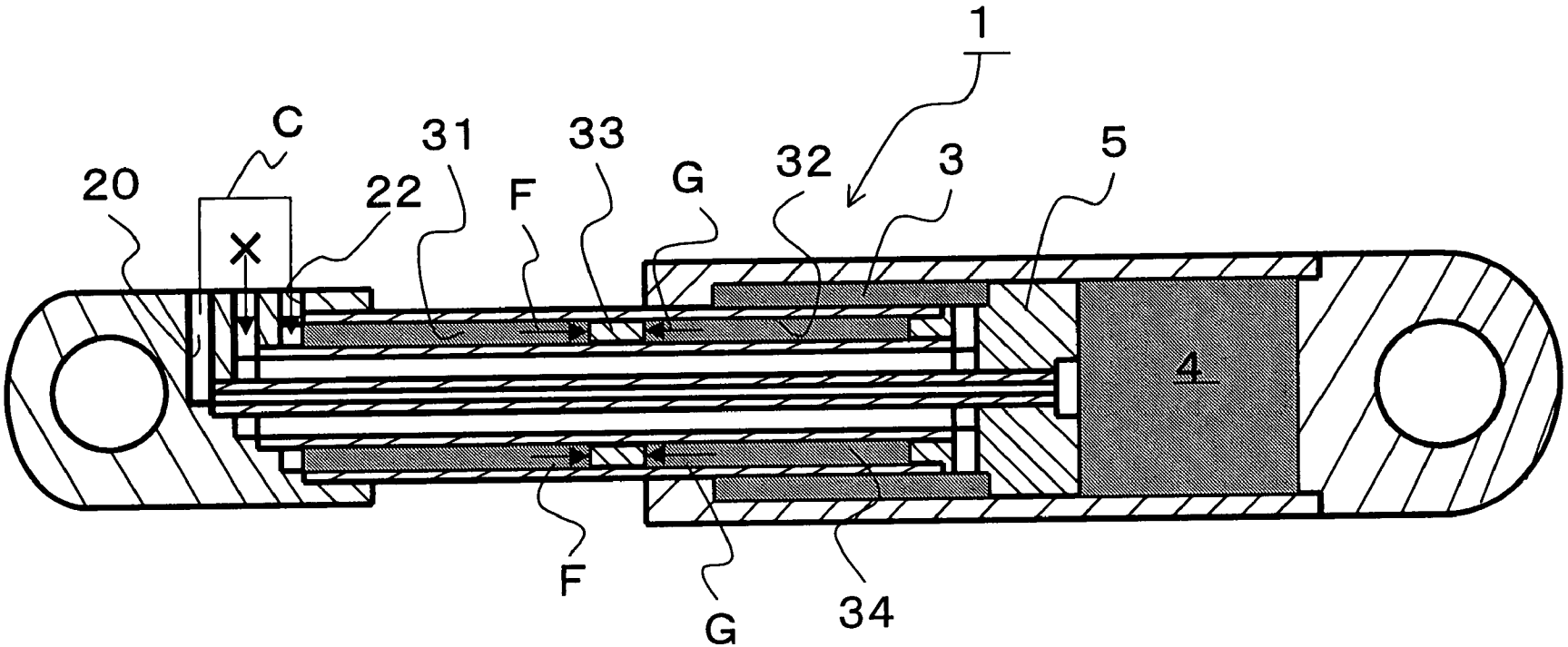
FIG. 9 is a schematic sectional view showing a state that the shock absorbing function of the hydraulic cylinder according to the embodiment of the present invention is activated.

Thus, when the operating oil C of the second cylinder chamber 4 flowing out of the head side port 20 is guided into the first cylinder rod chamber 31 of the accumulator 30, the accumulator piston 33 is pushed by the pressure of the operating oil C compressed by the cylinder piston 5 as shown in FIG. 9. The pressure F reduces gradually before the pressure F and the pressure G because of the compressive gas 34 hermetically charged into the second cylinder rod chamber 32 are mutually balanced with the accumulator piston 33 between them.

Therefore, when the accumulator 30 is used, a shock produced when the cylinder piston 5 is stopped at a desired position between the head side and the bottom side of the cylinder piston 5 in the cylinder 2 can also be absorbed in the same way by the damper function of the accumulator 30 utilizing the compressibility of the gas 34.

In the above embodiment, after the gas 34 constituting the accumulator 30 of the hydraulic cylinder 1 is hermetically charged into the first cylinder rod chamber 32, its damper function cannot be changed by exchanging the gas 34 and changing the gas charge pressure or the like of the gas 34 unless the hydraulic cylinder 1 itself is disassembled.

However, by a simple design change of using a fourth tube having a larger diameter for surrounding the third guide tube 12, the exchange of the gas hermetically charged into the first cylinder rod chamber 32 and the easy change of the gas charge pressure or the like become possible.

Figure 10:
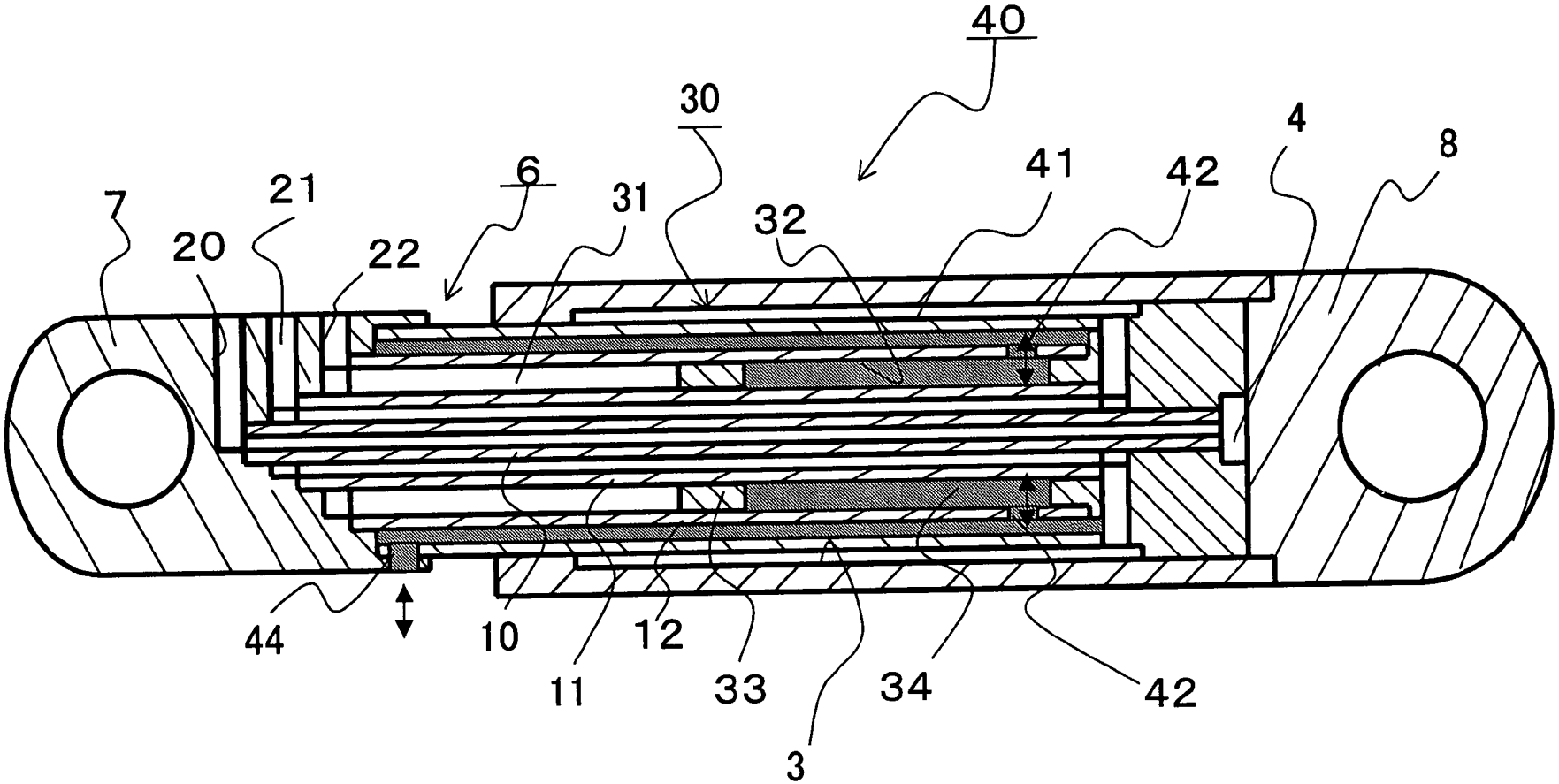
FIG. 10 is a schematic sectional view showing a hydraulic cylinder according to another embodiment of the present invention.

FIG. 10 is a schematic sectional view of a hydraulic cylinder 40 showing another embodiment of the present invention by which the exchange of the gas 34 hermetically charged into the first cylinder rod chamber 32 and the easy change of the gas charge pressure or the like of the gas 34 can be made. In FIG. 10, the same numerals are used to denote the same parts in FIG. 1.

The cylinder rod 6 of the hydraulic cylinder 40 has a concentric fourfold pipe structure comprising the first guide tube 10 having a small diameter, the second guide tube 11 having an intermediate diameter for surrounding the first guide tube 10, the third guide tube 12 having a large diameter for surrounding the second guide tube 11, and a fourth guide tube 41 having a larger diameter for surrounding the third guide tube 12 having the large diameter.

In the cylinder rod 6 of the hydraulic cylinder 40, the second cylinder rod chamber 32 that is divided by the accumulator piston 33 and filled with the compressive gas 34 is communicated with the fourth guide tube 41 through a hole 42 formed in the third guide tube 12, and the interior of the fourth guide tube 41 is communicated with a gas supply port 44 formed in the rod head 7.

Therefore, according to the cylinder rod 6 having the above-described concentric fourfold pipe structure, the gas supply port 44 is communicated with the second cylinder rod chamber 32 that is filled with the compressive gas 34 through the fourth guide tube 41 and the hole 42.

By charging the gas 34 into the second cylinder rod chamber 32 via the gas supply port 44, the exchange of the gas 34 is filled in the second cylinder rod chamber 32, and the change work of the gas charge pressure or the like of the gas 34 can be executed easily from the outside of the hydraulic cylinder 40.

Accordingly, the gas charge pressure of the gas 34 charged into the second cylinder rod chamber 32 is easily changed from the outside of the hydraulic cylinder 40, and the damper function of the accumulator 30 can be changed as desired according to the shock absorbing function of the required working machine.

The gas supply port 44 is sealed after charging the gas 34.

In the above-described embodiment, the head side port 20, the bottom side port 21, the accumulation port 22 and the gas supply port 44 are collectively formed adjacent to one another in the rod head 7, so that it is quite easy to connect the control valve for controlling in various ways and the individual ports by controlling the input/output of the operating oil.

In the above-described embodiment, the accumulator 30 is used for only the shock absorbing function of the hydraulic cylinder 1. The accumulator 30 may be used as a single accumulator in the hydraulic circuit serving as a single accumulator for preventing pulsation of the hydraulic pressure in the hydraulic circuit as its inherent function, thereby to make the hydraulic circuit small and compact.

In the embodiments described above, the hydraulic cylinders 1, 40 were described mainly concerning the shock absorbing function of the accumulator 30. The accumulator 30 of the hydraulic cylinders 1, 40 according to the present invention can execute not only the shock absorbing function but also the damper function when the hydraulic cylinders 1, 40 are stopped.

Specifically, in a construction machine such as a wheel loader, the bucket is driven by the hydraulic cylinder to load earth and sand in the bucket, the hydraulic cylinder is stopped from operating so as to put the hydraulic cylinder in a hold state. Thereafter, when the construction machine moves with the earth and sand loaded in the bucket, it receives shocks and vibrates because of bumps or the like on a road surface. As a result, the earth and sand loaded in the bucket may fall down from the bucket.

To prevent this, in a conventional hydraulic cylinder, the accumulator is connected to the hydraulic cylinder independent form the bucket cylinder hydraulic circuit that supplies the hydraulic cylinder with the operating oil so as to absorb or reduce a shock applied to the vehicle by means of the compressibility of the gas filled in the accumulator. The accumulator 30 for the hydraulic cylinders 1, 40 according to the present invention can naturally activate the damper function at the above-described time of holding the cylinder.

As shown in FIG. 9, if a shock is applied to the hydraulic cylinder 1 when it is held with the cylinder rod stopped, a pressure is applied to the operating oil C as the cylinder piston 5 fixed to the cylinder rod moves. And, the accumulator piston 33 is pushed by the pressure. Its pressure F reduces gradually before the pressure F and the pressure G of the compressive gas 34 hermetically charged into the second cylinder rod chamber 32 are mutually balanced with the accumulator piston 33 between them.

Therefore, the accumulator 30 for the hydraulic cylinders 1, 40 of the present invention can achieve the damper function at the time of holding the cylinder as described-above, and the accumulator 30 is disposed within the cylinder rod 6, so that the damper function at the time of holding the cylinder can be compact in comparison with the convention connection of the accumulator independent of the bucket cylinder hydraulic cylinder for supplying the operating oil to the hydraulic cylinder.

The hydraulic cylinders 1, 40 of the present invention is so configured that, when the cylinder rod 6 drops freely under its own weight or under load weight in a direction that the hydraulic cylinders 1, 40 are retracted, the head side port 20 and the accumulation port 22 are communicated with each other as shown in FIG. 7 to guide the operating oil C of the second cylinder chamber 4 flowing out of the head side port 20 into the first cylinder rod chamber 31 of the accumulator 30 so that the compressive gas 34 hermetically charged into the second cylinder rod chamber 32 is compressed and accumulated in the accumulator 30. With this configuration, when the cylinder rod 6 of the hydraulic cylinder 1 is extended, the pressure accumulated in the accumulator 30 is transferred to and released from the second cylinder chamber 4 via the operating oil C. The accumulated energy is used to extend easily the cylinder rod 6 of the hydraulic cylinder 1. Thus, the energy accumulated in the accumulator 30 can be recovered and reused to provide energy savings. The recovery and reuse of the energy accumulated in the accumulator 30 are very effective when the hydraulic cylinders 1, 40 of the present invention are particularly used for a forklift or a aerial service vehicle used for working at a high altitude.

What is claimed is:

1. A hydraulic cylinder comprising:

a cylinder piston that is inserted into a cylinder and divides the cylinder into a first cylinder chamber and a second cylinder chamber; and a cylinder rod having the cylinder piston fixed to one end thereof, and a rod head fixed to another end of the cylinder rod, wherein:

the cylinder rod is of a concentric triple tube structure comprising a first guide tube, a second guide tube surrounding the first guide tube, and a third guide tube surrounding the second guide tube;

the first guide tube has one end that is communicated with the second cylinder chamber, and another end that is communicated with a head side port formed in the rod head, and the second guide tube has one end that is communicated with the first cylinder chamber and another end that is communicated with a bottom side port formed in the rod head; and the third guide tube has in an interior thereof an accumulator comprising an accumulator piston that is inserted into the third guide tube and divides the interior of the third guide tube into a first cylinder rod chamber and a second cylinder rod chamber, compressive gas that is charged into the second cylinder rod chamber, and an accumulation port that is formed in the rod head and communicated with the first cylinder rod chamber.

2. The hydraulic cylinder according to claim 1, wherein the head side port, the bottom side port and the accumulation port are formed in mutually adjacent positions of the rod head, respectively.

3. A hydraulic cylinder comprising:

a cylinder piston that is inserted into a cylinder and divides the cylinder into a first cylinder chamber and a second cylinder chamber; and a cylinder rod having the cylinder piston fixed to one end thereof, and a rod head fixed to another end of the cylinder rod, wherein:

the cylinder rod is of a concentric triple tube structure comprising a first guide tube, a second guide tube surrounding the first guide tube, and a third guide tube surrounding the second guide tube;

the first guide tube has one end that is communicated with the second cylinder chamber, and another end that is communicated with a head side port formed in the rod head, and the second guide tube has one end that is communicated with the first cylinder chamber and another end that is communicated with a bottom side port formed in the rod head;

the third guide tube has in an interior thereof an accumulator comprising an accumulator piston that is inserted into the third guide tube and divides the interior of the third guide tube into a first cylinder rod chamber and a second cylinder rod chamber, compressive gas that is charged into the second cylinder rod chamber, and an accumulation port that is formed in the rod head and communicated with the first cylinder rod chamber; and the second cylinder rod chamber in which the gas is filled is communicated with the fourth guide tube via a hole formed in the third guide tube, and the fourth guide tube is communicated with a gas supply port formed in the rod head.

4. The hydraulic cylinder according to claim 3, wherein the head side port, the bottom side port and the accumulation port are formed in mutually adjacent positions of the rod head, respectively.

* * * * *